US005582468A

United States Patent [19]

Latham

[11] Patent Number: 5,582,468

[45] Date of Patent: Dec. 10, 1996

[54] DOUBLE TOOTH CUTTER

[75] Inventor: Winchester E. Latham, Indianapolis, Ind.

[73] Assignee: Keystone Engineering & Manufacturing Corporation, Indianapolis, Ind.

[21] Appl. No.: 515,441

[22] Filed: Aug. 15, 1995

[51] Int. Cl.[6] ..... E21C 35/18

[52] U.S. Cl. ..... 299/106; 299/87.1

[58] Field of Search ..... 299/83.1, 87.1, 299/106

[56] References Cited

U.S. PATENT DOCUMENTS

| | | | |
|---|---|---|---|
| 3,614,164 | 10/1971 | Davis | 299/83.1 |
| 3,847,439 | 11/1974 | Allen | 299/81.1 |
| 4,139,318 | 2/1979 | Jakob et al. | 404/90 |
| 4,268,089 | 5/1981 | Spencer | 299/87.1 |
| 4,311,284 | 1/1982 | Ratcliff, Jr. | 241/191 |
| 4,325,580 | 4/1982 | Swisher, Jr. et al. | 404/90 |
| 4,342,486 | 8/1982 | O'Neill | 299/106 X |
| 4,480,873 | 11/1984 | Latham | 299/87.1 |
| 4,637,753 | 1/1987 | Swisher et al. | 404/90 |
| 4,697,850 | 10/1987 | Tuneblom | 299/87.1 |
| 5,052,757 | 10/1991 | Latham | 299/87.1 |
| 5,098,167 | 3/1992 | Latham | 299/104 |
| 5,318,351 | 6/1994 | Walker | 299/106 |

FOREIGN PATENT DOCUMENTS

| | | | |
|---|---|---|---|
| 3644601 | 7/1988 | Germany | 299/106 |

*Primary Examiner*—David J. Bagnell
*Attorney, Agent, or Firm*—Locke Reynolds

[57] ABSTRACT

A cutting drum adapted to be mounted in a roadway surface reclaiming machine includes a cylindrical surface rotatably driven about its axis in a cutting direction. A plurality of cutter bit holding elements are distributed in a pattern over and fixed to the cylindrical surface, each cutter bit holding element having a base portion including a first opening and a second opening. A first cutter bit is received in the first opening and a second cutter bit is received in the second opening. The first and second openings are positioned so that the second cutter bit trails immediately behind and is aligned with the first cutter bit when the cylindrical surface is rotated in the cutting direction, the first and second cutter bits being inclined forwardly in the cutting rotation direction. The first and second openings are situated at two different heights so that the second cutter bit is situated at a greater radial distance from the rotation axis of the cylindrical surface than is the first cutter bit. The first and second openings includes a cylindrical lip portion circumscribing the cutter bit and defining the upper perimetral margin of the openings. The first cutter bit projects outward from the first opening by a distance sufficient to preclude substantial abrasive wear of the second opening cylindrical lip portion thus prolonging the usable life of the cutter bit holding elements.

19 Claims, 4 Drawing Sheets

DOUBLE TOOTH CUTTER

BACKGROUND OF THE INVENTION

The present invention relates generally to cutting elements for rotary driven cylindrical cutters and scarifiers for use in earth working, mining, or other in situ disintegration of hard materials. The invention is particularly directed to such cutting elements for use on a cylindrical surface portion of a rotary driven drum having utility in connection with roadway planing machines, also known as roadway surface reclaiming machines, employed prior to roadway resurfacing.

In general, roadway surface reclaiming machines disclosed in the prior art include a rotary driven cylindrical comminuting drum which acts to scarify and to mine the top portion of an asphaltic road surface in situ. The rotary driven drum typically includes flighting which acts to collect materials mined from the road surface toward a central portion of the drum which material is then removed from the road surface. Usually, the mined material is remixed with additional bituminous material and thereafter redeposited on the roadway as a newly formed smooth asphaltic surface. Examples of prior art apparatus are to be found in U.S. Pat. Nos. 4,139,318, 4,311,284, 4,325,580, 4,480,873 and 5,098,167.

In some prior art devices of this general class, the flighting is formed from a plurality of cutting bit support elements which are mounted on the cylindrical surface of the cutting drum. The cutting bit support members are arranged end-to-end or otherwise in close proximity to form a substantially continuous helical flighting. The top surface of the helical flighting is spaced outward from the cylindrical surface of the drum. The top surface includes forwardly angled openings into which conventional cutting bits are received. The individual cutting bit support members are fixed to the cutting drum cylindrical surface by bolts or other fasteners, or sometimes are welded in place.

In some other prior art devices of this general class, continuous flighting segments, which are adapted to receive cutting bit support members, are welded otherwise fixed to the cylindrical surface of the drum in helical fashion. A plurality of individual cutting bit and support blocks are then fixed to an upper portion of the flighting. Each support block includes a recess for receiving a conventional cutting bit. Each cutting bit constitutes a prong or tine having a tip formed of tungsten carbide or other very hard material adapted to withstand the abrasive character of the roadway being mined by the apparatus.

The hardness of the materials forming the surface of a roadway to be mined can vary substantially depending on the type of aggregate used in its original construction, the age of the surface being mined, weather conditions to which the road has been historically subjected, as well as the current weather conditions at the time of the mining. Many other factors make the life expectancy of the cutting bits unpredictable with cutting bit failure often occurring catastrophically due to rather high value sudden shocks. In the usual course, the failure of individual cutting bits is often not immediately noted thus causing abrasive contact between the cutting bit support member holding the failed cutting bit and the road surface sought to be mined as well as the material removed therefrom by other cutting bits which remain functioning. The cutting bit support members are typically formed of materials, such as steel, which are substantially softer than tungsten carbide and are subject to considerable wear over even short periods of time as the roadway surface reclaiming machine continues to operate. Further, the failure of one bit generally causes adjacent bits to undertake larger than normal mining loads which can lead to premature catastrophic failure of these adjacent bits as well. Such failures demand immediate replacement of the failed cutting bits as well as repair or replacement of the cutting bit supporting members which are damaged as a result of the missing cutting bits. This is a time consuming repair job typically requiring the use of a cutting torch by a welder in the field which results in considerable expense to the machine operator and loss of production time.

Thus, an object of the present invention is to provide a cutting bit holding element designed to hold cutting bits in such a fashion as to preclude substantial abrasive wear of the cutting bit holding element even in the event of catastrophic failure of the cutting bit held by that holding element. An additional object of the present invention is to provide a cutting bit holding element designed to hold cutting bits is such a fashion as to protect the cutting bit holding element even in the event of catastrophic failure of one of the cutting bits.

SUMMARY OF THE INVENTION

In accordance with the present invention, a plurality of cutter bit holding elements are distributed in a pattern over the surface of and are fixed directly or indirectly to the surface of a cylindrical cutting drum adapted to be mounted for powered rotation in any roadway surface reclaiming machine. Each of the cutter bit holding elements include a base portion having a first opening and a second opening. A first cutter bit is received in the first opening and a second cutter bit is received in the second opening. The first and second openings are positioned so the second cutter bit trails substantially immediately behind, and is aligned with, the first cutter bit when the cylindrical drum is rotated in the cutting direction. The first and second openings are situated at two different heights so the second cutter bit is situated at a greater radial distance from the rotation axis of the cylindrical drum than is the first cutter bit. In this way, the second cutter bit performs the dominant portion of the mining action due to its extended radial projection. The openings receiving the two cutter bits include a cylindrical lip portion which circumscribes the cutter bit and defines the upper perimeter margin of the opening. In the event of failure of the upper bit, the lower bit serves as a substitute which continues to abrade the working surface of the roadway being prepared for resurfacing. The first cutter bit projects outward from the first opening by a distance sufficient to preclude substantial abrasive wear of the second opening cylindrical lip portion at all times, even in the event of catastrophic failure of the second cutter bit, thus prolonging the usable life of the cutter bit holding elements and the cutter drum as a whole.

One feature of the holding elements of the present invention is each holding element holds two cutter bits with one of the cutter bits being positioned higher, that is at a greater radial distance from the axis of rotation of the cylindrical drum, than is the other cutter bit. The two cutter bits are preferably positioned at an angle to strike the working roadway surface at the same effective attack angle. One advantage of the holding elements of the present invention is the lower more forward bit serves as a substitute for the upper bit whenever the upper bit is worn or damaged. Thus use of the cutter drum using holding elements of the present invention can continue until all of the carbide of the upper bit is worn or broken away over a significant proportion of the drum thus lowering the frequency of periodic servicing. The lower bit also acts to protect the holder itself from substantial wear thereby extending productive life of the cutter drum. The invention has the additional advantage of reducing the downtime by enabling a cutter drum to be used for prolonged periods of time, often for a whole working day, before service is required. The invention also has the advantage of simplifying the service since the holding elements do not need to be replaced since they have been protected from unnecessary abrasive wear which would otherwise mandate replacement of the holding element.

Additional features and advantages of the present invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF PREFERRED EMBODIMENTS

Figure 2:
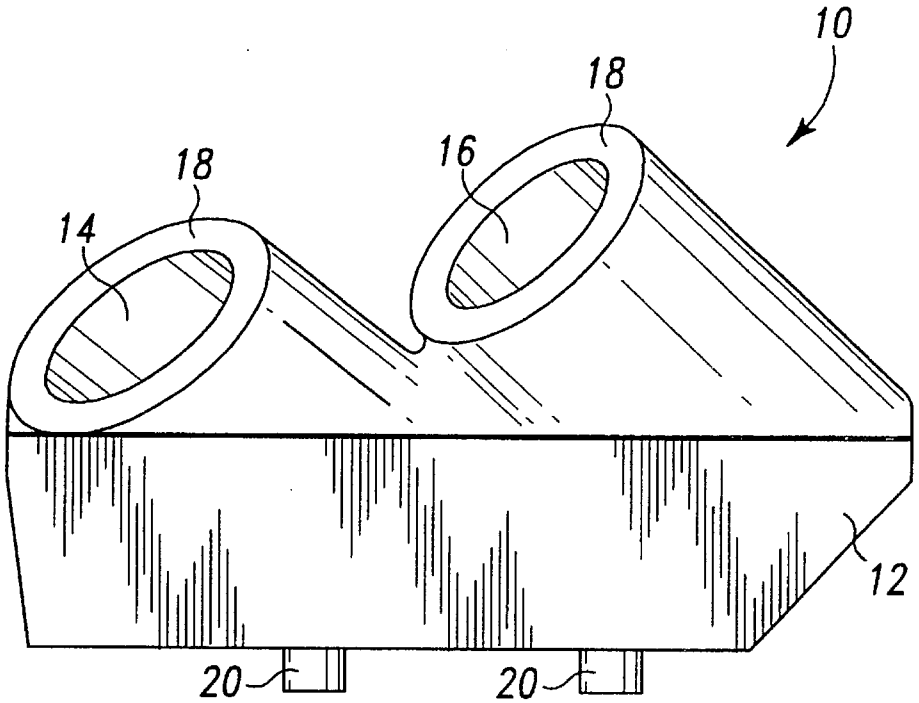
FIG. 2 is an elevation view from the right side of the cutting bit holding element shown in FIG. 1.
Figure 1:
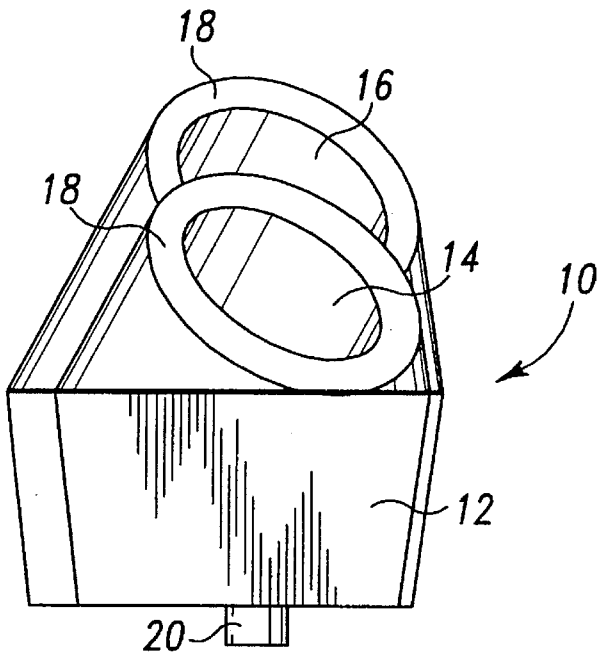
FIG. 1 is a front elevation view of a cutting bit holding element for a double tooth cutter in accordance with the present invention.

One embodiment of a cutting bit holding element 10 constructed in accordance with the present invention is shown in FIGS. 1 and 2 to include a base portion 12 having a first opening 14 and a second opening 16. The first and second openings are situated at different heights, the second opening 16 being higher than the first opening 14. The openings 14 and 16 are each defined by an annular lip portion 18 which circumscribes and defines an upper perimetral margin of each opening. The base portion 12 can include one or more downwardly projecting pins 20 which act to align the cutter bit holding element with respect to an underlying mounting, not shown in FIGS. 1 and 2.

Figure 4:
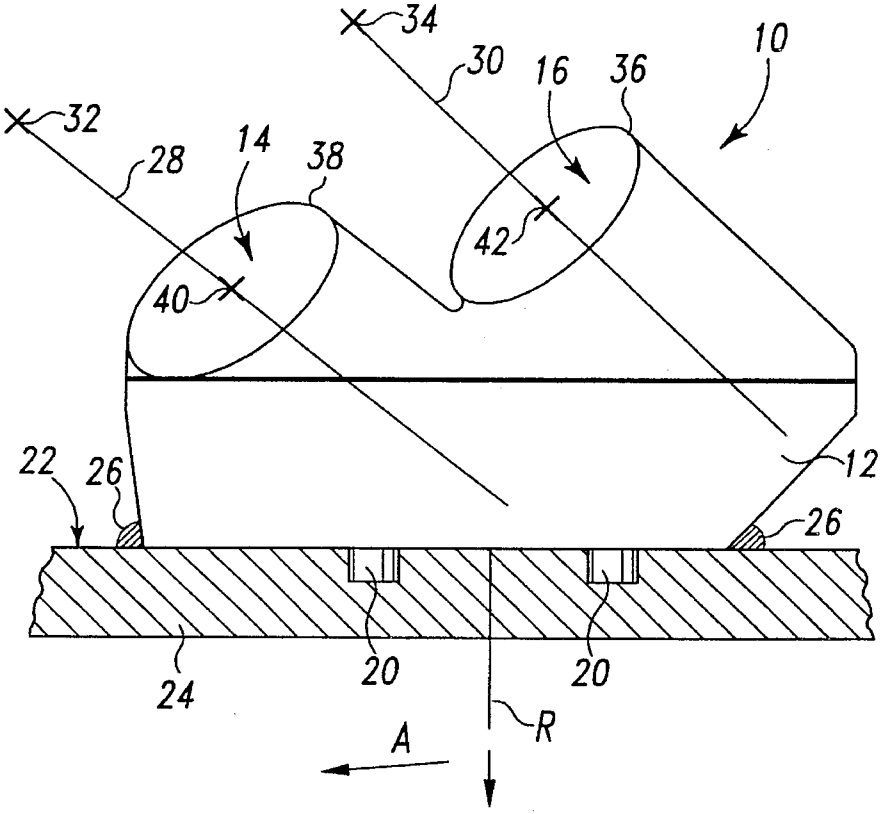
FIG. 4 is a diagrammatic view from the right side of FIG. 3.
Figure 3:
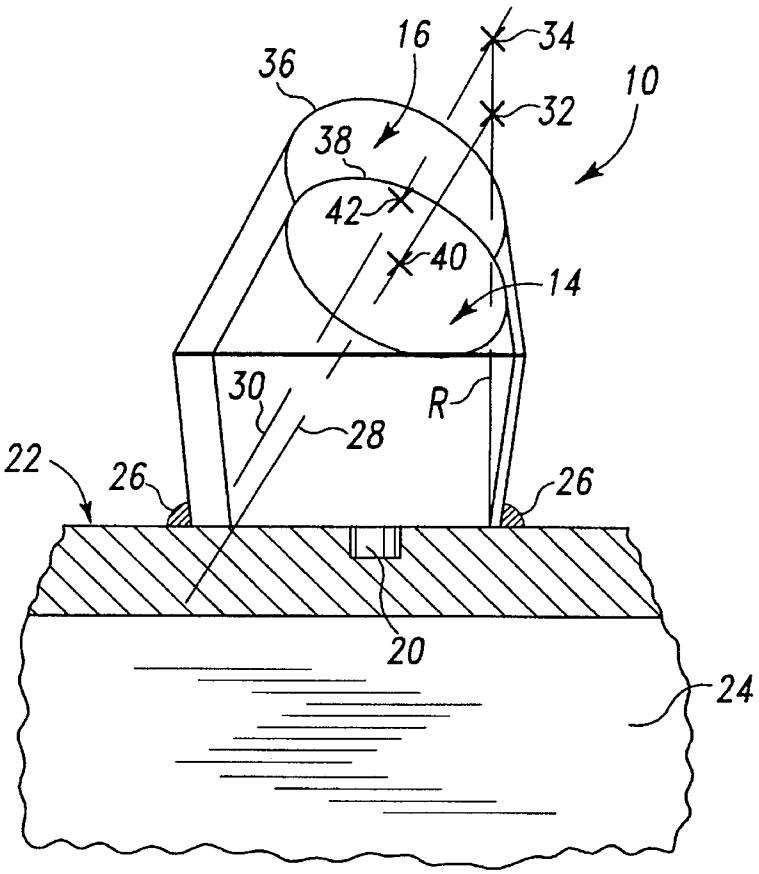
FIG. 3 is a diagrammatic view of the cutting bit holding element of FIG. 1 showing it attached directly to a cylindrical surface portion of a rotary driven drum shown broken away.

FIGS. 3 and 4 diagrammatically show the bit holding elements of FIGS. 1 and 2 fixed to an outer cylindrical surface 22 of a rotatably driven drum 24. The pins 20 on the base portion 12 of the cutter bit holding element 10 extend downward into recesses in the outer surface 22. The base 12 is secured to the outer surface 22 of drum 24 by means of a weld line 26 so that the base is generally perpendicular to a radius line R passing through the axis of rotation (not shown) of the drum 24. In normal use, the drum 24 is rotated in the direction A which is directly out of the plane of FIG. 3. Line segments 28 and 30 show the relative position of the center line or axis of the two cutter bits received in the two openings 14 and 16. The cutter bits employed with a holder 10 of the present invention are generally in the shape of an elongated cylinder having a conically shaped upper end terminating in a tip of hardened material such as carbide. The upper ends or tips of the cutter bits are designated by points 32 and 34. It can be seen that the tip 34 of the second cutting bit received in opening 16 is higher than is tip 32 of the first cutter bit received in the first opening 14. That is, point 34 is at a greater radial distance from the axis of rotation of the drum. This insures that at least initially, the principal abrasive contact between the surface to be mined and the cutting elements held by the cutter bit holder 10 will be performed by the bit received in the second opening 16. In the event of catastrophic failure of the second bit, or as a result of normal wear of the second bit due to prolonged use, the first bit will assume an increasing amount of the abrasive contact with the surface to be mined.

The points 40 and 42 constitute the intersection of axis line segments 28 and 30 with the plane defined by the first and second openings 14 and 16, respectively. It will be noted that the intersection point 42 at the center of opening 16 is positioned at about the same height as the upper margin 38 of perimeter 18 of the first opening 14. It is to be further noted that the upper end 32 of the first bit is positioned at about the same radial height as the upper margin 36 of the second opening. The effect of this is that the cutter bit located in the first opening acts to protect the upper margin 18 defining the second opening 16 even in the event that the second cutter bit has been damaged or destroyed through catastrophic failure.

The cutter bits indicated by the line segments 28 and 30 are inclined both forwardly, as shown in FIG. 4, and to one side, as shown in FIG. 3. The angle of inclination of the two cutter bits is shown to be nearly the same, the differences in angle of inclination being such that the two cutter bits are positioned to strike the working roadway surface at the same effective attack angle. The angle of intersection between the cutter bit axes 28 and 30 and a radius line such as R passing through the cylindrical axis of the drum can vary between about 20° and 50°, the preferred angles being to the function of the size of the drum and the inclination of the flighting formed by the cutter bit holding element 10 or to which the cutter holding bit is mounted.

Figure 5:
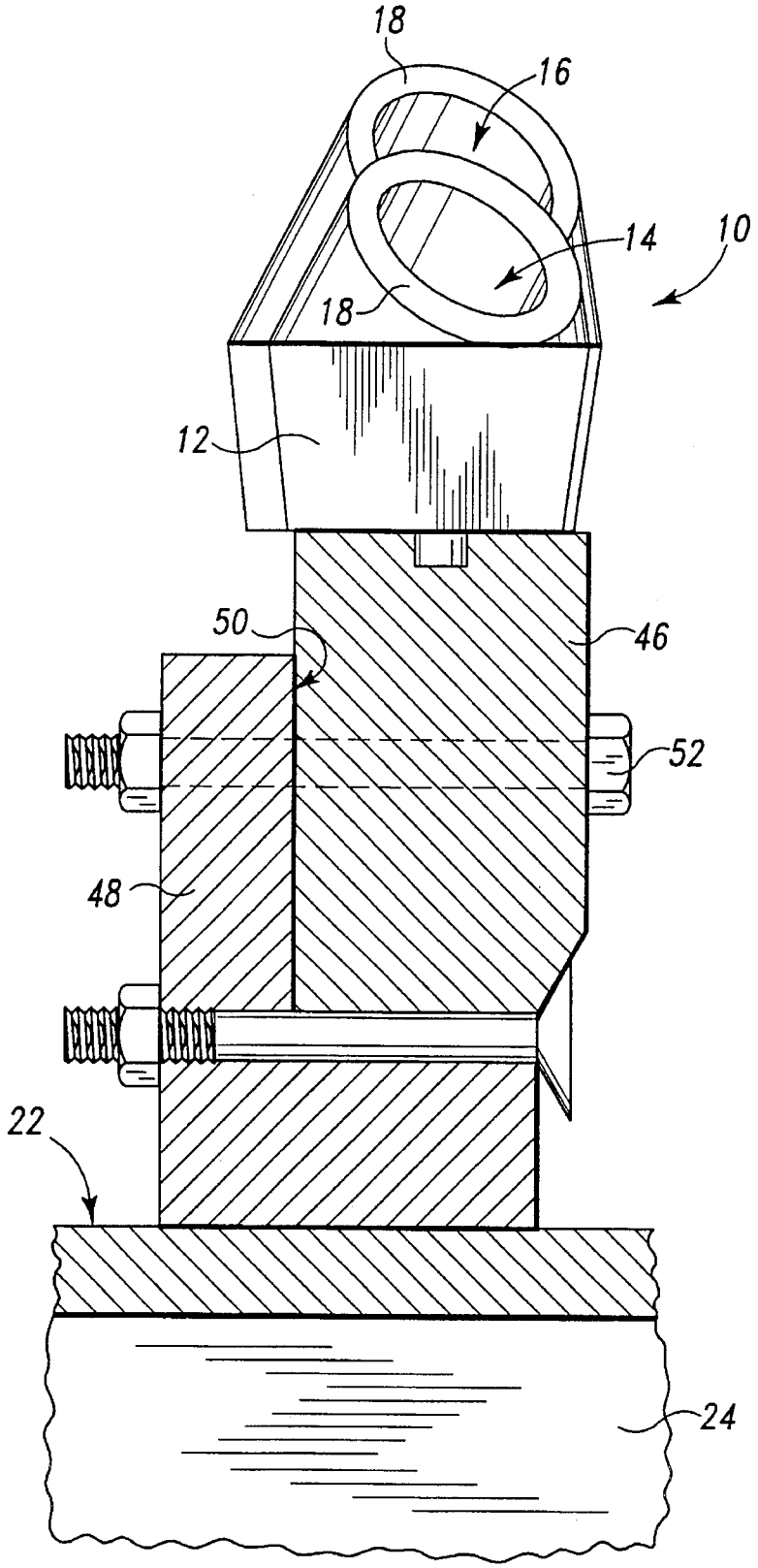
FIG. 5 is a front view partially in section of another embodiment of a cutting bit holding element for a double tooth cutter in accordance with the present invention shown bolted to flighting on a cylindrical surface portion of a rotary driven drum in the general manner shown in U.S. Pat. No. 4,480,873 or European Patent 04 62 485.

FIG. 5 shows another embodiment of the present invention wherein the base 12 is fixed to a lower extension 46. A spiral flighting segment 48 projects radially outward from and is fixed to a surface 22 of a drum 24 and includes recesses 50 adapted to receive base extensions 46 of the cutter bit holding element 10. A plurality of fasteners employed to secure the cutter bit holding element 10 to the flighting bit 48. Alternatively, the lowermost extension 46 can be secured to the flighting 48 by welding.

Figure 6:
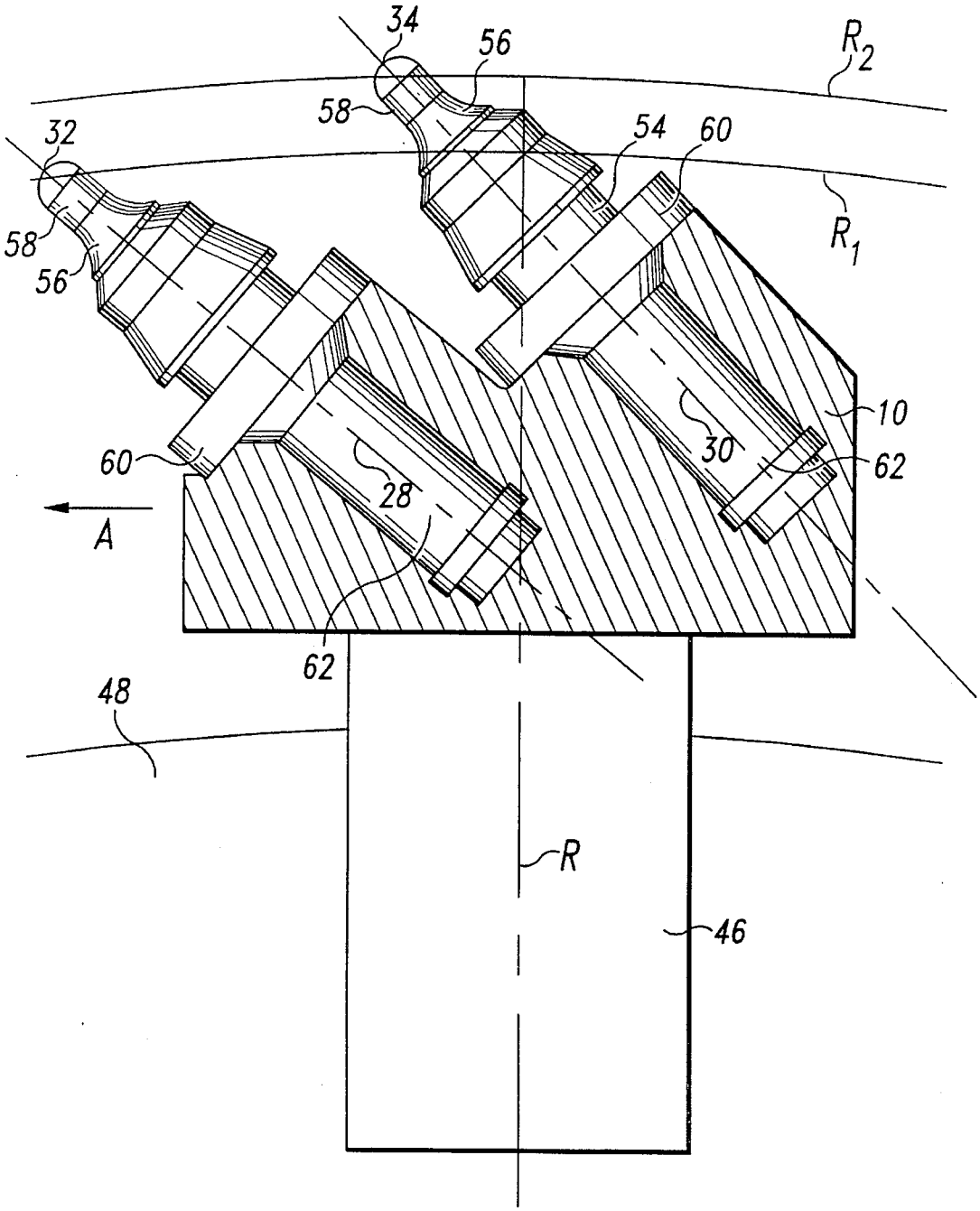
FIG. 6 is a side elevation view showing yet another embodiment of a cutting bit holding element with cutting bits installed and mounted to a spiral flighting on an underlying portion of a rotary driven drum.

Another variation is shown in FIG. 6 wherein the radius distance of the tips 32 and 34 of the first and second bit are shown to be $R_1$ and $R_2$, respectively. Each of the bits are shown to comprise conventional, generally elongated cylinders 54 having a conically shaped upper ends 56 terminating in a tip 58 of hardened material such as carbide, and having a shoulder 60 abutting the perimeter 18 surrounding each bit receiving opening 14 and 16, and a butt end portion 62 received in the openings.

Although the invention has been described in detail with reference to preferred embodiments, variations and modifications exist within the scope and spirit of the invention as described and as claimed in the following claims.

What is claimed is:

1. A cutter bit holding element for use on a cylindrical surface portion of a drum adapted to be rotated about its cylindrical axis in a cutting direction, the cutter bit holding element comprising a base portion including a first opening and a second opening adapted to receive a first cutter bit and a second cutter bit, respectively, mounting means for mounting the base portion to the drum cylindrical surface so that the first and second openings are positioned in a common plane intersecting a point on the cylindrical axis of the drum, each of the first and second openings defining a cutter bit alignment axis inclined with respect to the base portion and aligned parallel to each other, the first and second openings being situated at two different heights with respect to the base portion, each of the first and second openings including a cylindrical lip portion circumscribing the cutter bit alignment axis of each opening defining the upper perimetral margin of the openings, an uppermost point of the cylindrical lip portion of the first opening lying in a plane parallel to the base portion passing through a point defined by the intersection of the cutter bit alignment axis of the second opening and a plane containing the cylindrical lip portion of the second opening.

2. The cutter bit holding element of claim 1 wherein each cutter bit alignment axis lies in said common plane intersecting a point on the cylindrical axis of the drum, the angle of intersection being between about 0° and 35°.

3. The cutter bit holding element of claim 1 wherein the mounting means includes a pair of pins projecting downwardly from a lowermost surface of the base.

4. The cutter bit holding element of claim 1 wherein the mounting means includes a tapered surface on a lower forward edge of the base.

5. The cutter bit holding element of claim 4 wherein the mounting means further includes at least one aperture through the base adapted to receive a threaded fastener.

6. The cutter bit holding element of claim 5 wherein said at least one aperture is threaded to engage a threaded fastener.

7. A cutting drum adapted to be mounted in a roadway surface reclaiming machine, the cutting drum comprising a cylindrical surface, means for rotating the cylindrical surface about its rotation axis in a cutting direction, a plurality of cutter bit holding elements distributed over and fixed to the cylindrical surface, each cutter bit holding element having a base portion including a first opening and a second opening, a first cutter bit and a second cutter bit received in the first opening and the second opening, respectively, mounting means for mounting the base portion to the cylindrical surface so that the first and second openings are positioned so that the second cutter bit trails immediately behind and is aligned with the first cutter bit when the cylindrical surface is rotated in the cutting direction, the first and second cutter bits being inclined forwardly in the cutting rotation direction, the first and second openings being situated at two different heights with respect to the base portion so that the second cutter bit is situated at a greater radial distance from the rotation axis of the cylindrical surface than is the first cutter bit.

8. The cutting drum of claim 7 wherein each of the first and second openings includes a cylindrical lip portion circumscribing the cutter bit alignment axis of each opening defining the upper perimetral margin of the openings, the first cutter bit projecting outward from the first opening by a distance sufficient to preclude substantial abrasive wear of the second opening cylindrical lip portion.

9. The cutting drum of claim 7 wherein each base is fixed to the cylindrical surface at an offset angle of between about 0° and 35°, the cutter bits being received in each base at a corresponding offset angle.

10. The cutting drum of claim 7 wherein the mounting means includes a pair of pins projecting downwardly from a lowermost surface of the base.

11. The cutting drum of claim 7 wherein the bases are fixed to the cylindrical surface immediately adjacent to each other so as to form individual segments of flighting extending in an arcuate pattern around the cylindrical surface.

12. The cutting drum of claim 7 further comprising flighting fixed to the surface of the cylindrical surface, the flighting including openings for receiving the cutter bit holding element base portions.

13. The cutting drum of claim 12 wherein the mounting means includes a tapered surface on a lower forward edge of the base.

14. The cutting drum of claim 12 wherein the mounting means further includes at least one aperture through the base adapted to receive a threaded fastener.

15. The cutting drum of claim 14 wherein said at least one aperture is threaded to engage a threaded fastener.

16. A cutting drum adapted to be mounted in a roadway surface reclaiming machine, the cutting drum comprising a cylindrical surface, means for rotating the cylindrical surface about its rotation axis in a cutting direction, a plurality of cutter bit holding elements distributed over and fixed to the cylindrical surface, the plurality of cutter bit holding elements having a base portion and being arranged to provide pairs of openings in the form of first openings and second openings, first cutter bits and second cutter bits received in the first openings and the second openings, respectively, mounting means for mounting the base portions to the cylindrical surface so that each of the second cutter bits trails immediately behind and is aligned with one of the first cutter bits when the cylindrical surface is rotated in the cutting direction, the first and second openings being situated at two different heights with respect to the cylindrical surface so that the second cutter bit is situated at a greater radial distance from the rotation axis of the cylindrical surface than is the first cutter bit.

17. The cutting drum of claim 16 wherein the cutter bit holding elements are fixed to the cylindrical surface immediately adjacent to each other so as to form individual segments of flighting extending in an arcuate pattern around the cylindrical surface.

18. The cutting drum of claim 16 further comprising flighting fixed to the surface of the cylindrical surface, the flighting including openings for receiving the cutter bit holding element base portions.

19. The cutting drum of claim 16 wherein each of the cutter bit holding elements includes one of both the first openings and the second openings.

* * * * *